US006719532B2

(12) United States Patent
Bird

(10) Patent No.: US 6,719,532 B2
(45) Date of Patent: Apr. 13, 2004

(54) HIGH EFFICIENCY CEILING FAN

(75) Inventor: Gregory Michael Bird, Colliersville, TN (US)

(73) Assignee: Hunter Fan Company, Memphis, TN (US)

( * ) Notice: Subject to any disclaimer, the term of this patent is extended or adjusted under 35 U.S.C. 154(b) by 3 days.

(21) Appl. No.: 10/209,044

(22) Filed: Jul. 30, 2002

(65) Prior Publication Data

US 2004/0009070 A1 Jan. 15, 2004

Related U.S. Application Data

(63) Continuation-in-part of application No. 10/194,699, filed on Jul. 11, 2002.

(51) Int. Cl.[7] ..... F04D 29/38

(52) U.S. Cl. ..... 416/210 R; 416/238; 416/243; 416/DIG. 5

(58) Field of Search ..... 416/238, 243, 416/223 R, DIG. 2, DIG. 5, 5, 242, 210 R

(56) References Cited

U.S. PATENT DOCUMENTS

| | | | | | |
|---|---|---|---|---|---|
| 4,640,668 | A | * | 2/1987 | Yang | 417/354 |
| 4,782,213 | A | | 11/1988 | Teal | 219/372 |
| 4,892,460 | A | | 1/1990 | Volk | 416/62 |
| 4,974,633 | A | | 12/1990 | Hickey | 137/561 |
| 5,033,113 | A | | 7/1991 | Wang | 455/603 |
| D330,759 | S | * | 11/1992 | Rezek | D23/377 |
| 5,244,349 | A | | 9/1993 | Wang | 416/231 |
| 6,039,541 | A | | 3/2000 | Parker et al. | 416/223 |

FOREIGN PATENT DOCUMENTS

| | | | |
|---|---|---|---|
| GB | 676406 | 7/1952 | 416/223 |
| WO | WO 92/07192 | 4/1992 | 25/8 |

* cited by examiner

*Primary Examiner*—Edward K. Look
*Assistant Examiner*—Kimya N McCoy
(74) *Attorney, Agent, or Firm*—Baker Donelson

(57) ABSTRACT

Ceiling fan energy consumption efficiency is enhanced with fan blades that have an angle attack that decreases from root end to tip end at higher rates of decrease nearer their tip ends than at their root ends. Air flow distribution is enhanced with at least a portion of the blades having a dihedral that continuously increases.

12 Claims, 3 Drawing Sheets

HIGH EFFICIENCY CEILING FAN

REFERENCE TO RELATED APPLICATION

This is a continuation-in-part of application Ser. No. 10/194,699 filed Jul. 11, 2002.

TECHNICAL FIELD

This invention relates generally to ceiling fans, and specifically to electrically powered ceiling fans and their efficiencies.

BACKGROUND OF THE INVENTION

Ceiling fans powered by electric motors have been used for years in circulating air. They typically have a motor within a housing mounted to a downrod that rotates a set of fan blades about the axis of the downrod. Their blades have traditionally been flat and oriented at an incline or pitch to present an angle of attack to the air mass in which they rotate. This causes air to be driven downwardly.

When a fan blade that extends generally radially from its axis of rotation is rotated, its tip end travels in a far longer path of travel than does its root end for any given time. Thus its tip end travels much faster than its root end. To balance the load of wind resistance along the blades, and the air flow generated by their movement, fan blades have been designed with an angle of attack that diminishes towards the tip. This design feature is also conventional in the design of other rotating blades such as marine propellers and aircraft propellers.

In 1997 a study was conducted at the Florida Solar Energy Center on the efficiencies of several commercially available ceiling fans. This testing was reported in U.S. Pat. No. 6,039,541. It was found by the patentees that energy efficiency, i.e. air flow (CFM) per power consumption (watts), was increased with a fan blade design that had a twist in degrees at its root end that tapered uniformly down to a smaller twist or angle of attack at its tip end. For example, this applied to a 20-inch long blade (with tapered chord) that had a 26.7° twist at its root and a 6.9° twist at its tip.

Another long persistent problem associated with ceiling fans has been that of air flow distribution. Most ceiling fans have had their blades rotate in a horizontal plane, even though oriented at an angle of attack. This has served to force air downwardly which does advantageously provide for air flow in the space beneath the fan. However air flow in the surrounding space has been poor since it does not flow directly from the fan. Where the fan blades have been on a dihedral this problem has been reduced. However this has only been accomplished at the expense of a substantial diminution of air flow directly beneath the fan.

SUMMARY OF THE INVENTION

It has now been found that a decrease in angle of attack or twist that is of a uniform rate is not the most efficient for ceiling fans. The tip of a 2-foot blade or propeller travels the circumferences of a circle or $2\pi$ (2) in one revolution. Thus its midpoint one foot out travels $2\pi$ (1) or half that distance in one revolution. This linear relation is valid for an aircraft propeller as its orbital path of travel is generally in a plane perpendicular to its flight path. A ceiling fan however rotates in an orbital path that is parallel to and located below an air flow restriction, namely the ceiling itself. Thus its blades do not uniformly attack an air mass as does an aircraft. This is because "replacement" air is more readily available at the tips of ceiling fan blades than inboard of their tips. Air adjacent their axis of rotation must travel from ambience through the restricted space between the planes of the ceiling and fan blades in reaching their root ends.

With this understanding in mind, ceiling fan efficiency has now been found to be enhanced by forming their blades with an angle of attack that increases non-uniformly from their root ends to their tip ends. More specifically, it has been found that the rate of change in angle of attack or pitch should be greater nearer the blade tip than nearer its root. This apparently serves to force replacement air inwardly over the fan blades beneath the ceiling restriction so that more air is more readily available nearer the root ends of the blades. But whether or not this theory is correct the result in improved efficiency has been proven. By having the change in angle of attack at a greater rate at their tip than at their roots, fan efficiency has been found to be substantially enhanced.

Air flow distribution is now also improved with a ceiling fan that has its blades formed with upward curves that provide a continuously graduated dihedral. Preferably this is continuous from their root ends to their tip. Moreover this may be done in combination with the just described non-uniform decrease in their angle of attack or twist. The result is the provision of a ceiling fan that is not only highly efficient but which also distributes air better.

DETAILED DESCRIPTION

The fan blade technology disclosed in U.S. Pat. No. 6,039,541 followed the assumption that all air flow into the fan blades is from a direction that is perpendicular to the plane of rotation for the blades. In addition, it assumed that the airflow is of a constant velocity from the root end to the tip end of the blades as used in aircraft propeller theory. Using this assumption the blades were designed with a constant twist rate from root end to tip end.

Twisting of the blade is done in an attempt to optimize the relative angle of attack of the airflow direction relative to the blade surface. This is done to ensure that the blade is operating at its optimum angle of attack from root end to tip end. This angle changes to accommodate the fact that the tip of the blade moves faster than the root end of the blade diameter. This increase in velocity changes the direction of the relative wind over the blade.

Again, this assumption has now been found to be invalid for ceiling fans. Ceiling fans are air re-circulating devices that do not move through air as an aircraft propeller does. Air does not move in the same vector or even velocity over their blades from root end to tip end.

Figure 1:
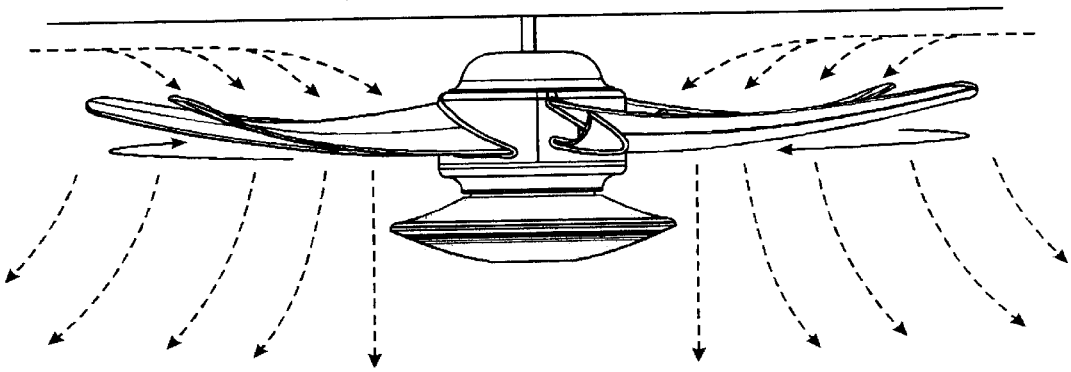
FIG. 1 is a side view of a ceiling fan that embodies the invention in its preferred form.

FIG. 1 illustrates a ceiling fan that is of conventional construction with the exception of the shape of its blades. The fan is seen to be mounted beneath a ceiling by a downrod that extends from the ceiling to a housing for an electric motor and switch box. Here the fan is also seen to have a light kit at its bottom. Power is provided to the motor that drives the blades by electrical conductors that extend through the downrod to a source of municipal power.

The fan blades are seen to be twisted rather than flat and to have a graduated dihedral. Air flow to and from the fan blades is shown by the multiple lines with arrowheads. From these it can be visually appreciated how the fan blades do not encounter an air mass as does an airplane propeller. Rather, the restricted space above the blades alters the vectors of air flow into the fan contrary to that of an aircraft.

Figure 2:
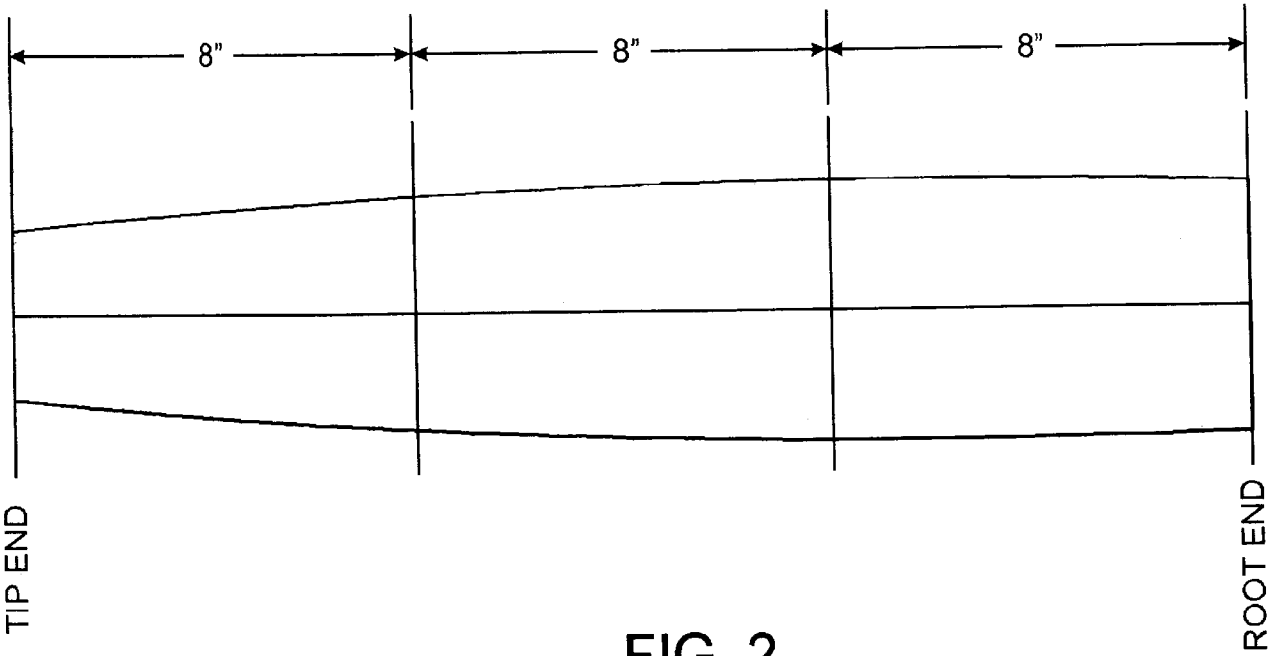
FIG. 2 is a diagrammatical view of a fan blade of FIG. 1 shown hypothetically in a planar form for illustrative purposes.

Each fan blade is tapered with regard to its width or chord as shown diagrammatically in FIG. 2. Each tapers from base or root end to tip end so as to be narrower at its tip. In addition, each preferably has a dihedral as shown in FIG. 1 although that is not necessary to embody the advantages of the invention. The dihedral is provided for a wider distribution of divergence of air in the space beneath the fan.

Figure 3:
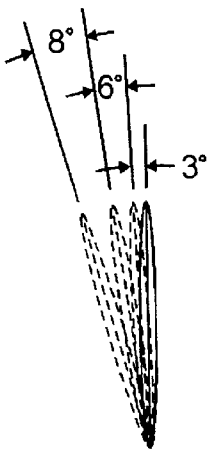
FIG. 3 is a diagrammatical view of the fan blade of FIG. 2 illustrating degrees of blade twist at different locations along the blade.

With continued reference to FIGS. 2 and 3 it is seen that the blade is demarked to have three sections although the blade is, of course, of unitary construction. Here the 24-inch long blade has three sections of equal lengths, i.e. 8 inches each. All sections are twisted as is evident in FIG. 1. However the rate of twist from root to tip is nonuniform. The twist or angle of attack deceases from root end down to 10° at the tip end. This decrease, however, which is also apparent in FIG. 1, is at three different rates. In the first 8-inch section adjacent the root end the change in twist rate is 0.4° per inch. For the mid section it is 0.7° per inch. For the third section adjacent the tip it is at a change rate of 1.0° per inch. Of course there is a small transition between each section of negligible significance. Thus in FIG. 3 there is an 8° difference in angle of attack from one end of the outboard section to its other (1° per inch×8 inches). For the mid section there is about 6° difference and for the inboard section about 3°.

Figure 5:
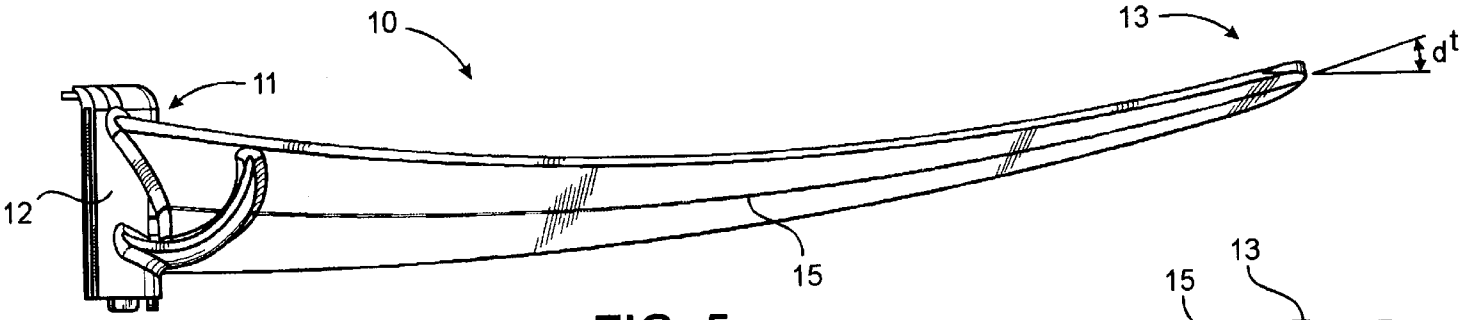
FIG. 5 is a side view of one of the blades of the fan shown in FIG. 1.
Figure 7:
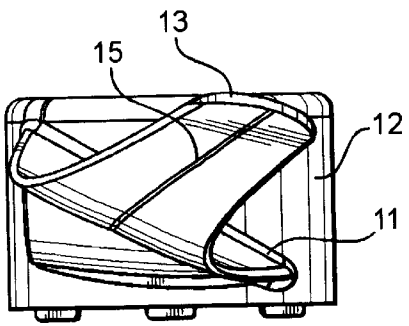
FIG. 7 is an end-on view of one of the blades of the fan shown in FIG. 1.
Figure 6:
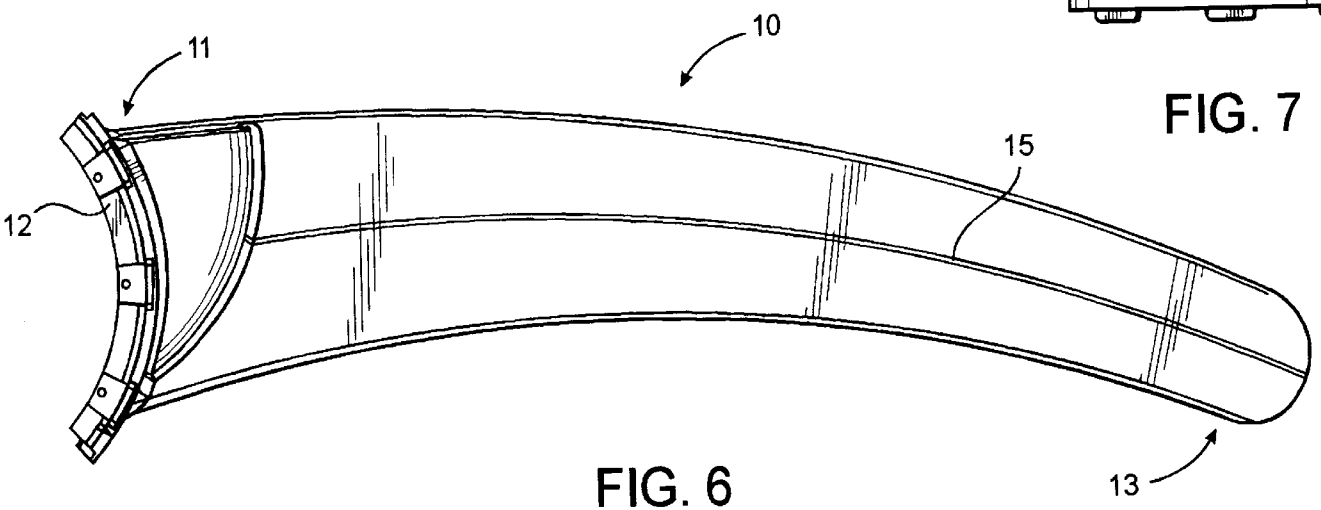
FIG. 6 is a top view of one of the blades of the fan shown in FIG. 1.

FIGS. 5–7 show one of the blades 10 of the fan of FIG. 1 in greater detail. The blade is seen to have its root end 11 mounted to the fan motor rotor hub 12 with its tip end 13 located distally of the hub. The hub rotates about the axis of the downrod from the ceiling as shown in FIG. 1 which is substantially vertical. As most clearly noted by the blade centerline 15, the blade has a 0° dihedral at its root end 11 and a 10° dihedral $d^t$ at its tip 13. The fan blade here is continuously arched or curved from end to end so that its dihedral is continuously changing from end to end. As shown by the air flow distribution broken lines in FIG. 1 this serves to distribute air both directly under the fan as well as in the ambient air space that surrounds this space. Conversely, fans of the prior art have mostly directed the air downwardly beneath the fan with air flow in the surrounding space being indirect and weak. Though those fans that have had their blades inclined at a fixed dihedral throughout their length have solved this problem, such has been at the expense of diminished air flow directly under the fan.

The blade dihedral may increase continuously from end to end. However, it may be constant near its root end and/or near its tip with its arched or curved portion being along its remainder. Indeed, the most efficient design, referred to as the gull design, has a 0° dihedral from its root end to half way to its tip, and then a continuously increasing dihedral to its tip where it reaches a dihedral of 10°. In the preferred embodiment shown the blade root end has a 0° dihedral and its tip a 10° dihedral. However, its root end dihedral may be less than or more than 0° and its tip less than or more than 10°. Fan size, power, height and application are all factors that may be considered in selecting specific dihedrals.

Figure 4:
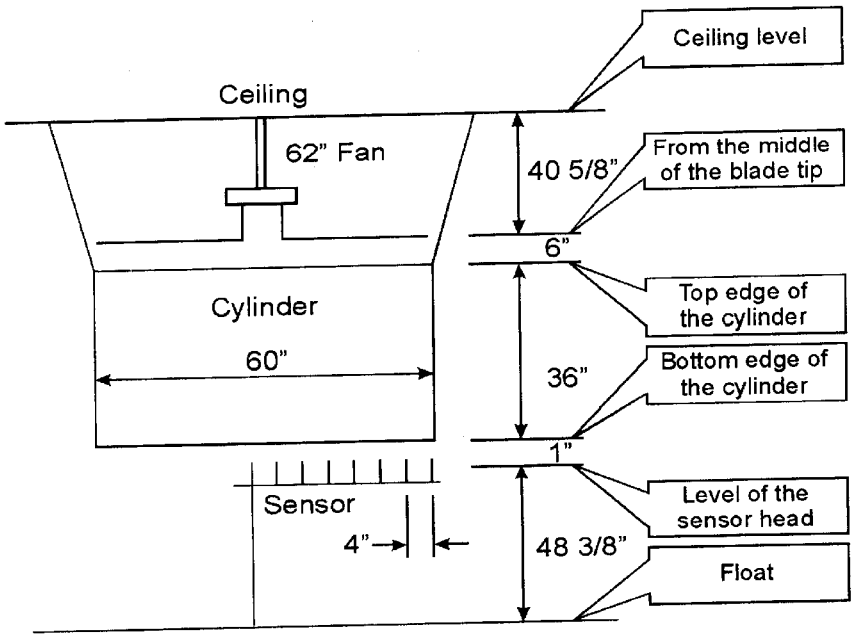
FIG. 4 is a diagram of air flow test parameters.

The fan was tested at the Hunter Fan Company laboratory which is certified by the environmental Protection Agency, for Energy Star Compliance testing. The fan was tested in accordance with the Energy Star testing requirements except that air velocity sensors were also installed over the top and close to the fan blades. This allowed for the measurement of air velocity adjacent to the fan blade. During the testing it was determined that the velocity of the air is different at various places on the fan blades from root end to tip end. Test parameters are shown in FIG. 4. The actual test results appear in Table 1.

TABLE 1

| Sensor | Avg. Vel. FPM | Air V FPS | Rotor Vel FPS | Resultant Vel | Resultant Angle | Deg/inch |
|---|---|---|---|---|---|---|
| 0 | 283 | 4.7 | 22.7 | 23.2 | 11.7 | |
| 1 | 303 | 5.1 | 24.4 | 24.9 | 11.7 | 0.07 |
| 2 | 320 | 5.3 | 26.2 | 26.7 | 11.5 | 0.16 |
| 3 | 325 | 5.4 | 27.9 | 28.4 | 11.0 | 0.54 |
| 4 | 320 | 5.3 | 29.7 | 30.1 | 10.2 | 0.79 |
| 5 | 313 | 5.2 | 31.4 | 31.8 | 9.4 | 0.76 |
| 6 | 308 | 5.1 | 33.1 | 33.5 | 8.8 | 0.63 |
| 7 | 305 | 5.1 | 34.9 | 35.3 | 8.3 | 0.51 |
| 8 | 290 | 4.8 | 36.6 | 37.0 | 7.5 | 0.77 |
| 9 | 275 | 4.6 | 38.4 | 38.7 | 6.8 | 0.71 |
| 10 | 262 | 4.4 | 40.1 | 40.4 | 6.2 | 0.60 |
| 11 | 235 | 3.9 | 41.9 | 42.0 | 5.3 | 0.87 |
| 12 | 174 | 2.9 | 43.6 | 43.7 | 3.8 | 1.54 |
| 13 | 132 | 2.2 | 45.4 | 45.5 | 2.8 | 1.03 |

Comparative test results appear in Table 2 where blade 1 was the new one just described with a 10° fixed dihedral, blade 2 was a Hampton Bay Gossomer Wind/Windward blade of the design taught by U.S. Pat. No. 6,039,541, and blade 3 was a flat blade with a 15° fixed angle of attack. The tabulated improvement was in energy efficiency as previously defined.

TABLE 2

| Blade | Motor | With Cylinder | Improvement Over Hampton Bay | Improvement Over Standard | Without cylinder | Improvement Over Hampton Bay | Improvement Outside 4 ft |
|---|---|---|---|---|---|---|---|
| 1 | 172 × 18A M | 12,878 | 21% | 29% | 37,327 | 24% | 27% |
| 2 | 188 × 15 | 10,639 | NA | 6% | 30,034 | NA | NA |
| 3 | 172 × 18A M | 10,018 | −6% | NA | 28,000 | −7% | −7% |

It thus is seen that a ceiling fan now is provided of substantially higher energy efficiency than those of the prior art and with enhanced flow distribution. The fan may of course be used in other locations such as a table top. Although it has been shown and described in its preferred form, it should be understood that other modifications, additions or deletions may be made thereto without departure from the spirit and scope of the invention as set forth in the following claims.

What is claimed is:

1. A ceiling fan having a plurality of fan blades mounted for rotation about an upright fan axis of blade rotation and with each blade having a root end proximal said axis of rotation and a tip end distal said axis of rotation and wherein each blade has a greater angle of attack proximally said fan axis than distally said fan axis and with the rate of change in angle of attack there between being non-uniform, and wherein at least a portion of each blade is curved increasingly upwardly toward its tip end to have a continuously graduated dihedral for enhanced air flow distribution.

2. The ceiling fan of claim 1 wherein each blade is increasingly curved upwardly continuously from its root end to its tip end.

3. The ceiling fan of claim 2 wherein each blade has a dihedral of approximately 0° at its root end and a dihedral of approximately 10° at its tip end.

4. The ceiling fan of claim 1 wherein the blade angle of attack decreases continuously from proximally said fan axis to distally said fan axis.

5. The ceiling fan of claim 4 wherein each blade has a dihedral of approximately 10° at its tip end and an angle of attack of approximately 10° at its tip end.

6. A ceiling fan having a plurality of fan blades mounted for rotation about a generally vertical axis wherein each blade has a greater angle of attack proximally said fan axis than distally said fan axis with the rate of change in angle of attack therebetween being non-uniform, and with at least a portion of each blade being arched upwardly with continuously increased dihedral for enhanced air flow dispersion.

7. The ceiling fan of claim 6 wherein each blade is continuously arched upwardly from proximally its root end to proximally its tip.

8. The ceiling fan of claim 6 wherein each blade has a dihedral of approximately 0° at its root.

9. The ceiling fan of claim 6 which each blade has a dihedral of approximately 10° at its tip.

10. The ceiling fan of claim 6 wherein each blade has a dihedral of approximately 0° at its root end and an angle of attack of approximately 10° at its tip end.

11. The ceiling fan of claim 6 wherein each blade has a dihedral of approximately 0° from its root end to approximately half way to its tip and from half way to its tip to continuously increased dihedral.

12. The ceiling fan of claim 11 wherein each blade has a dihedral of approximately 10° at its tip.

* * * * *